US006102262A

United States Patent [19]

Nicholson

[11] Patent Number: 6,102,262

[45] Date of Patent: Aug. 15, 2000

[54] FOOTWEAR DONNING ASSIST ASSEMBLY

[76] Inventor: William Nicholson, 101 Acton Road, Acton, Tasmania 7170, Australia

[21] Appl. No.: 09/410,323

[22] Filed: Oct. 1, 1999

[51] Int. Cl.[7] ..... A47G 25/90

[52] U.S. Cl. ..... 223/112; 223/111

[58] Field of Search ..... 223/112, 111, 223/113, 115, 118

[56] References Cited

U.S. PATENT DOCUMENTS

| | | | |
|---|---|---|---|
| 5,069,374 | 12/1991 | Williamson et al. | 223/111 |
| 5,806,729 | 9/1998 | Ramon | 223/115 |
| 5,927,573 | 7/1999 | Votino et al. | 223/111 |
| 6,032,839 | 3/2000 | Joosten et al. | 223/112 |

*Primary Examiner*—Bibhu Mohanty

[57] ABSTRACT

A footwear donning assist assembly for making it easier, less strenuous and more convenient for a user to put on footwear. The footwear donning assist assembly includes an elongate base member, a foot support mount attached to a top side of the base member, a foot support member having a first end hingedly attached to an end of the base member and being supported at a slant upon the foot support mount, a sleeve-like foot receiving member mounted upon the foot support member and being dimensioned to have an article of footwear inserted therein with the open end of the footwear being draped about one end of the sleeve-like foot receiving member, and a flexible line having clip members at the ends thereof for grasping onto an article of footwear to assist pulling up the footwear over the foot and leg of a user.

12 Claims, 2 Drawing Sheets

FOOTWEAR DONNING ASSIST ASSEMBLY

BACKGROUND OF THE INVENTION

1. Field of the Invention

The present invention relates to a means for putting on footwear and more particularly pertains to a new footwear donning assist assembly for making it easier, less strenuous and more convenient for a user to put on footwear.

2. Description of the Prior Art

The use of a means for putting on footwear is known in the prior art. More specifically, a means for putting on footwear heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,066,194; 3,452,907; 3,715,065; U.S. Pat. No. Des. 375,819; U.S. Pat. Nos. 4,651,909; and 2,796,207.

While these devices fulfill their respective, particular objectives and requirements, the aforementioned patents do not disclose a new footwear donning assist assembly. The inventive device includes an elongate base member, a foot support mount attached to a top side of the base member, a foot support member having a first end hingedly attached to an end of the base member and being supported at a slant upon the foot support mount, a sleeve-like foot receiving member mounted upon the foot support member and being dimensioned to have an article of footwear inserted therein with the open end of the footwear being draped about one end of the sleeve-like foot receiving member, and a flexible line having clip members at the ends thereof for grasping onto an article of footwear to assist pulling up the footwear over the foot and leg of a user.

In these respects, the footwear donning assist assembly according to the present invention substantially departs from the conventional concepts and designs of the prior art, and in so doing provides an apparatus primarily developed for the purpose of making it easier, less strenuous and more convenient for a user to put on footwear.

SUMMARY OF THE INVENTION

In view of the foregoing disadvantages inherent in the known types of a means for putting on footwear now present in the prior art, the present invention provides a new footwear donning assist assembly construction wherein the same can be utilized for making it easier, less strenuous and more convenient for a user to put on footwear.

The general purpose of the present invention, which will be described subsequently in greater detail, is to provide a new footwear donning assist assembly apparatus and method which has many of the advantages of the means for putting on footwear mentioned heretofore and many novel features that result in a new footwear donning assist assembly which is not anticipated, rendered obvious, suggested, or even implied by any of the prior art a means for putting on footwear, either alone or in any combination thereof.

To attain this, the present invention generally comprises an elongate base member, a foot support mount attached to a top side of the base member, a foot support member having a first end hingedly attached to an end of the base member and being supported at a slant upon the foot support mount, a sleeve-like foot receiving member mounted upon the foot support member and being dimensioned to have an article of footwear inserted therein with the open end of the footwear being draped about one end of the sleeve-like foot receiving member, and a flexible line having clip members at the ends thereof for grasping onto an article of footwear to assist pulling up the footwear over the foot and leg of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new footwear donning assist assembly apparatus and method which has many of the advantages of the means for putting on footwear mentioned heretofore and many novel features that result in a new footwear donning assist assembly which is not anticipated, rendered obvious, suggested, or even implied by any of the prior art a means for putting on footwear, either alone or in any combination thereof.

It is another object of the present invention to provide a new footwear donning assist assembly which may be easily and efficiently manufactured and marketed.

It is a further object of the present invention to provide a new footwear donning assist assembly which is of a durable and reliable construction.

An even further object of the present invention is to provide a new footwear donning assist assembly which is susceptible of a low cost of manufacture with regard to both materials and labor, and which accordingly is then susceptible of low prices of sale to the consuming public, thereby making such footwear donning assist assembly economically available to the buying public.

Still yet another object of the present invention is to provide a new footwear donning assist assembly which provides in the apparatuses and methods of the prior art some of the advantages thereof, while simultaneously overcoming some of the disadvantages normally associated therewith.

Still another object of the present invention is to provide a new footwear donning assist assembly for making it easier, less strenuous and more convenient for a user to put on footwear.

Yet another object of the present invention is to provide a new footwear donning assist assembly which includes an elongate base member, a foot support mount attached to a top side of the base member, a foot support member having a first end hingedly attached to an end of the base member and being supported at a slant upon the foot support mount, a sleeve-like foot receiving member mounted upon the foot support member and being dimensioned to have an article of footwear inserted therein with the open end of the footwear being draped about one end of the sleeve-like foot receiving member, and a flexible line having clip members at the ends thereof for grasping onto an article of footwear to assist pulling up the footwear over the foot and leg of a user.

Still yet another object of the present invention is to provide a new footwear donning assist assembly that allows a user to easily without any strain to put on footwear.

Even still another object of the present invention is to provide a new footwear donning assist assembly that eliminates the user from having to completely stoop over to put on one's footwear which puts a lot of strain on the person's back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
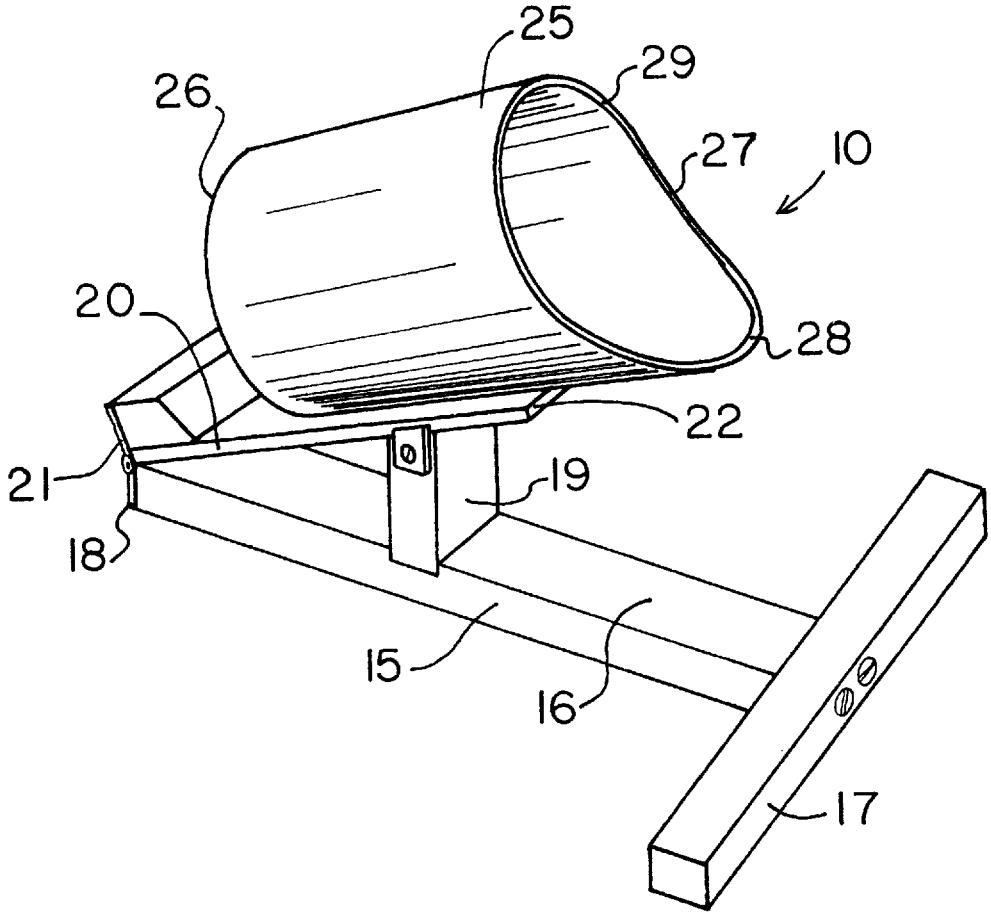
FIG. 1 is a perspective view of a new footwear donning assist assembly according to the present invention.
Figure 2:
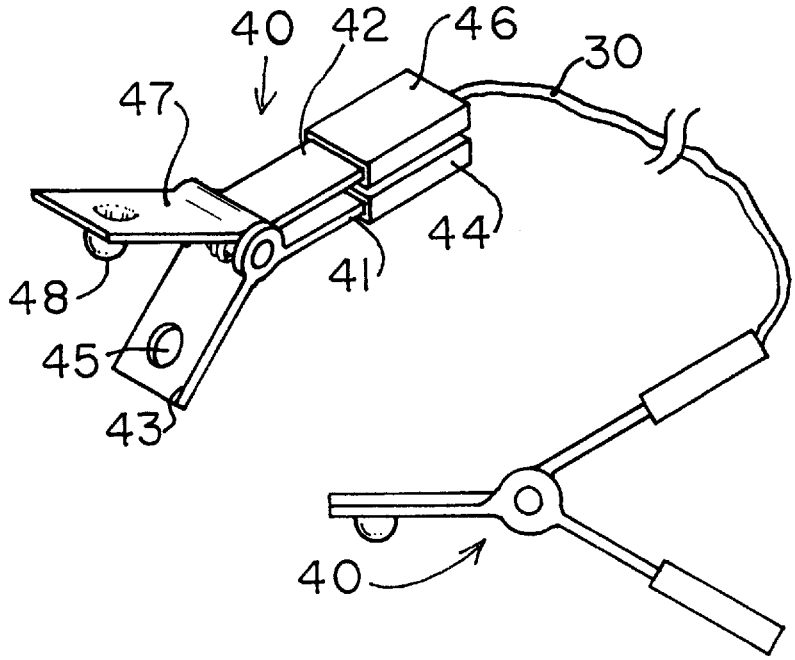
FIG. 2 is a perspective view of the means for pulling on the footwear of the present invention.
Figure 3:
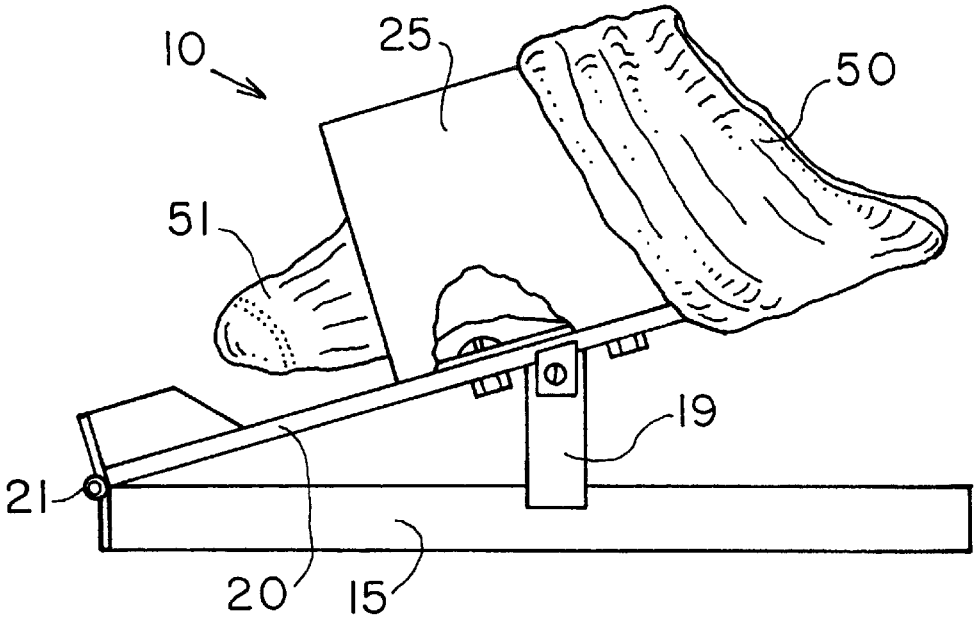
FIG. 3 is a side elevational view of the present invention.
Figure 4:
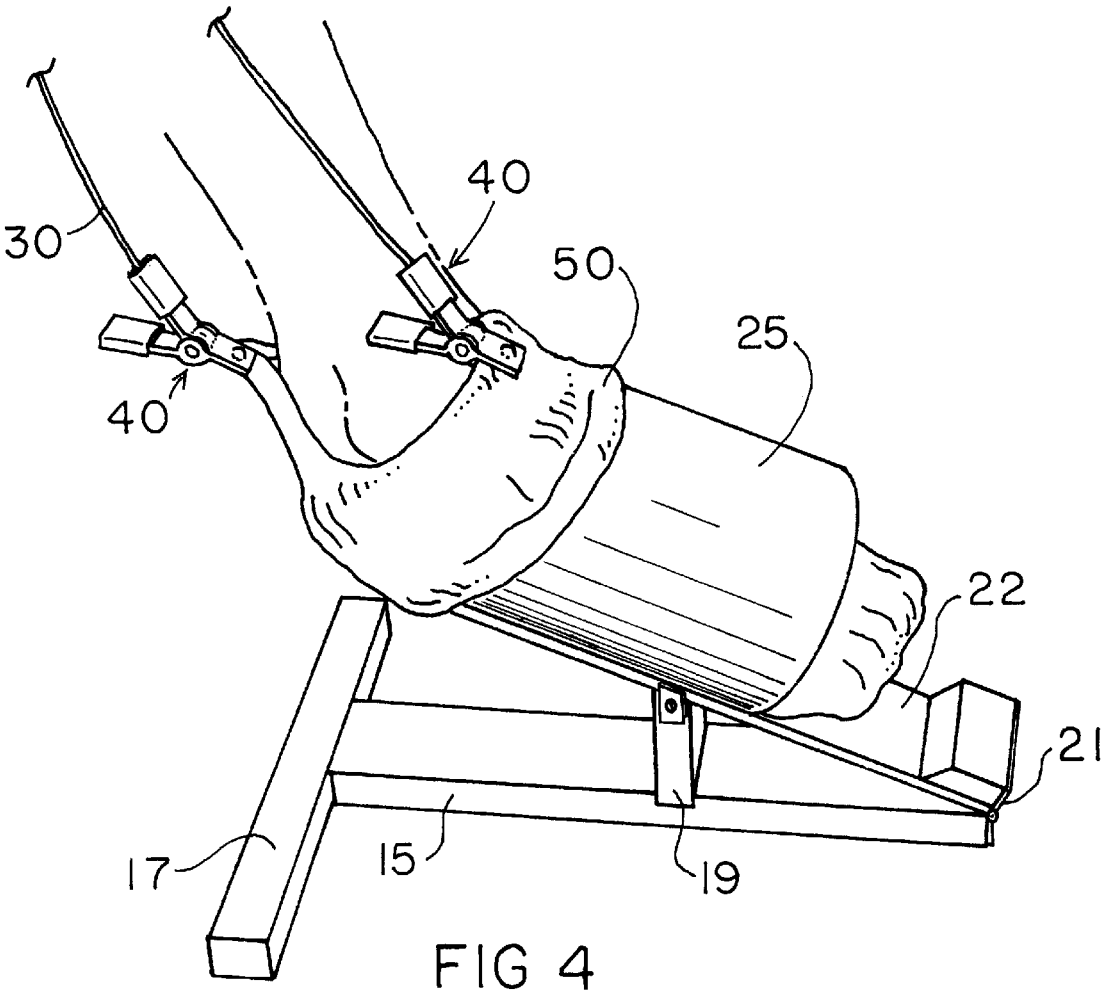
FIG. 4 is a perspective view of the present invention being used.

With reference now to the drawings, and in particular to FIGS. 1 through 4 thereof, a new footwear donning assist assembly embodying the principles and concepts of the present invention and generally designated by the reference numeral 10 will be described.

As best illustrated in FIGS. 1 through 4, the footwear donning assist assembly 10 generally comprises an elongate base member 15 having a first end 18 and a top side. The elongate base member 15 includes an elongate planar member 16 and a planar cross member 17 with the elongate base member 15 being essentially T-shaped, and further includes a foot support member 20 having a first end 21 hingedly attached to the first end 18 of the elongate base member 15 and further having a second end 22, and also includes a foot support mount 19 being securely and centrally mounted with conventional means upon the top side of the elongate base member 15. The foot support mount 19 extends upwardly from the elongate base member 15 with the foot support member 20 being supported upon the foot support mount 19 such that the foot support member 20 is slanted upwardly relative to the base member 15 with the second end 22 of the foot support member 20 being elevated above the base member 15, and further includes a sleeve-like foot receiving member 25 being securely and conventionally mounted upon the foot support member 20 at the second end 22 thereof with the sleeve-like foot receiving member 25 having a longitudinal axis which is disposed generally parallel to the length of the foot support member 20. The sleeve-like foot receiving member 25 has a front end 26 and back end 27 which is elevated relative to the front end 26 and is adapted to receive and support a user's heel. The back end 27 has a bottom portion 28 which extends rearwardly or outwardly relative to a top portion 29 of the back end 27 with the sleeve-like foot receiving member 25 being adapted to allow a user to extend one's foot through the back end 27 with the user's toes 51 essentially extending beyond a front end 26 of the sleeve-like foot receiving member 25. The sleeve-like foot receiving member 25 is adapted to receive footwear 50 such as a sock or hosiery therein. The footwear 50 is pulled up about the foot and part of the legs of a user with a flexible line 30 having spring-loaded clip members 40 at the ends of the flexible line 30. Each of the clip members 40 has a pair of elongate members 41, 42 which are centrally and conventionally connected to a shaft having a spring mounted thereabout. Each of the elongate members includes a jaw portion 43,47 at one end and a handle portion 44, 46 at the other end. One of the jaw portions 43 has an opening 45 therein, and the other of the jaw portions 47 has a lug member 48 extending outwardly therefrom and which is dimensioned to be received in the opening 45 of the other jaw portion 43 to engage a footwear 50 between the jaw portions 43, 47.

In use, a piece of footwear 50 is inserted through the back end 27 of the sleeve-like foot receiving member 25 with the open end of the footwear 50 being draped about the back end 27 of the sleeve-like foot receiving member 25. The user then places his or her foot through the back end 27 of the sleeve-like foot receiving member 25 with his/her toes 51 essentially extending beyond the front end 26 of the sleeve-like foot receiving member 25, and attaches the clip members 40 to the footwear 50, preferably one to each side of the foot and uses the flexible line 30 to urge the footwear 50 onto the foot and leg of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A footwear donning assist assembly comprising:

an elongate base member having a first end and a top side;

a foot support member having a first end attached to said first end of said elongate base and further having a second end;

a foot support mount being securely and centrally mounted upon said top side of said elongate base member;

a sleeve-like foot receiving member being securely mounted upon said foot support member; and a means for pulling footwear up over a user's foot and leg.

2. A footwear donning assist assembly as described in claim 1, wherein said elongate base member includes an elongate planar member and a planar cross member.

3. A footwear donning assist assembly as described in claim 2, wherein said elongate base member is essentially T-shaped.

4. A footwear donning assist assembly as described in claim 1, wherein said foot support mount extends upwardly from said elongate base member.

5. A footwear donning assist assembly as described in claim 4, wherein said foot support member is supported upon said foot support mount such that said foot support member is slanted upwardly relative to said base member with said second end of said foot support member being elevated above said base member.

6. A footwear donning assist assembly as described in claim 5, wherein said sleeve-like foot receiving member has a longitudinal axis which is disposed generally parallel to a length of said foot support member.

7. A footwear donning assist assembly as described in claim 6, wherein said sleeve-like foot receiving member has a back end which is adapted to receive a user's heel, said back end has a bottom portion which extends rearwardly relative to a top portion of said back end.

8. A footwear donning assist assembly as described in claim 7, wherein said sleeve-like foot receiving member is adapted to allow a user to extend one's foot through said back end with the user's toes essentially extending beyond a front end of said sleeve-like foot receiving member.

9. A footwear donning assist assembly as described in claim 8, wherein said sleeve-like foot receiving member is adapted to receive footwear such as a sock or hosiery therein.

10. A footwear donning assist assembly as described in claim 9, wherein said means for pulling footwear includes a flexible line having spring-loaded clip members at ends thereof, each of said clip members having a pair of elongate members each of which has a jaw portion at one end and a handle portion at the other end, said elongate members being connected at the other one's central portion.

11. A footwear donning assist assembly as described in claim 10, wherein one of said jaw portions includes an opening therein, and the other of said jaw portions includes a lug member which is dimensioned to be received in said opening to engage a footwear therebetween.

12. A footwear donning assist assembly comprising:

an elongate base member having a first end and a top side, said elongate base member including an elongate planar member and a planar cross member, said elongate base member being essentially T-shaped;

a foot support member having a first end attached to said first end of said elongate base member and further having a second end;

a foot support mount being securely and centrally mounted upon said top side of said elongate base member, said foot support mount extending upwardly from said elongate base member, said foot support member being supported upon said foot support mount such that said foot support member is slanted upwardly relative to said base member with said second end of said foot support member being elevated above said base member;

a sleeve-like foot receiving member being securely mounted upon said foot support member, said sleeve-like foot receiving member having a longitudinal axis which is disposed generally parallel to a length of said foot support member, said sleeve-like foot receiving member having a back end which is adapted to receive a user's heel, said back end has a bottom portion which extends rearwardly relative to a top portion of said back end, said sleeve-like foot receiving member being adapted to allow a user to extend one's foot through said back end with the user's toes essentially extending beyond a front end of said sleeve-like foot receiving member, said sleeve-like foot receiving member being adapted to receive footwear such as a sock or hosiery therein, said back end of said sleeve-like foot receiving member being elevated relative to said front end thereof; and a means for pulling footwear up over a user's foot and leg, including a flexible line having spring-loaded clip members at ends thereof, each of said clip members having a pair of elongate members each of which has a jaw portion and a handle portion, one of said jaw portions including an opening therein, and the other of said jaw portions including lug member which is dimensioned to be received in said opening to engage a footwear between said jaw portions.

* * * * *